US008474687B2

(12) United States Patent
Rometty et al.

(10) Patent No.: US 8,474,687 B2
(45) **Date of Patent: *Jul. 2, 2013**

(54) NESTABLE RIGID U-CRATES

(75) Inventors: John A. Rometty, Barrington, IL (US); Jeffrey W. O'Hara, Cherry Valley, IL (US); Lloyd W. Lenig, Plymouth, IN (US)

(73) Assignee: Illinois Tool Works Inc., Glenview, IL (US)

( * ) Notice: Subject to any disclaimer, the term of this patent is extended or adjusted under 35 U.S.C. 154(b) by 182 days.

This patent is subject to a terminal disclaimer.

(21) Appl. No.: 13/021,450

(22) Filed: Feb. 4, 2011

(65) Prior Publication Data

US 2011/0192757 A1 Aug. 11, 2011

Related U.S. Application Data

(63) Continuation-in-part of application No. 12/692,870, filed on Jan. 25, 2010.

(51) Int. Cl.
*B65D 6/16* (2006.01)
*B65D 21/04* (2006.01)

(52) U.S. Cl.
USPC ..... 229/122.32; 206/517; 220/4.26; 220/DIG. 25

(58) Field of Classification Search
USPC ..... 229/122.32, 125.19, 930, 931; 206/443, 206/453, 499, 517, 586; 220/4.26, DIG. 25
See application file for complete search history.

(56) References Cited

U.S. PATENT DOCUMENTS

| | | | | | |
|---|---|---|---|---|---|
| 769,915 | A | * | 9/1904 | Nostrand | 229/930 |
| 2,173,927 | A | * | 9/1939 | Allen | 229/931 |
| 2,233,207 | A | * | 2/1941 | Gillam | 229/930 |
| 2,391,791 | A | | 12/1945 | Irving | |
| 3,526,566 | A | * | 9/1970 | McIlvain, Jr et al. | 229/930 |
| 3,669,338 | A | * | 6/1972 | Cornell et al. | 229/122 |
| 4,976,374 | A | * | 12/1990 | Macaluso | 229/122.32 |
| 5,947,290 | A | * | 9/1999 | Loeschen | 206/517 |

(Continued)

FOREIGN PATENT DOCUMENTS

| | | | |
|---|---|---|---|
| EP | 1291296 | A1 | 3/2003 |
| JP | 2-258547 | A * | 10/1990 |
| WO | 8909733 | A1 | 10/1989 |

OTHER PUBLICATIONS

International Search Report and Written Opinion of the International Searching Authority issued in connection with PCT/US2010/022089 on Mar. 30, 2010.

*Primary Examiner* — Gary Elkins
(74) *Attorney, Agent, or Firm* — Levenfeld Pearlstein, LLC

(57) ABSTRACT

A high density nesting packaging element is a preformed, rigid U-shaped member. The U-shaped member has a base wall and upstanding opposing side walls, in which the intersection of the base and side walls is rigid. The base wall has a thickness and a narrow slit is formed in the base wall, extending longitudinally along the base wall. The slit is formed from an inner surface of the wall into the thickness of the base wall. The base wall is foldable along the slit so as to form a generally W-shaped configuration cross-section. When folded into the W-shaped configuration, the members are nestable with each other. When the member is unfolded to the U-shaped cross-section, the opposing surfaces formed by the slit abut one another to maintain the member in the U-shaped configuration.

13 Claims, 2 Drawing Sheets

U.S. PATENT DOCUMENTS 6,450,398 B1 * 9/2002 Muise et al. ..... 229/5.84
6,457,636 B1 10/2002 Van De Ven
6,794,018 B2 * 9/2004 Clark ..... 206/586
7,296,728 B2 * 11/2007 Gosis et al. ..... 206/443
7,661,579 B2 * 2/2010 Kruelle et al. ..... 229/930
8,038,003 B2 * 10/2011 Rometty et al. ..... 206/586

* cited by examiner

NESTABLE RIGID U-CRATES

CROSS-REFERENCE TO RELATED APPLICATION

This application is a continuation-in-part of U.S. patent application Ser. No. 12/692,870, filed Jan. 25, 2010, entitled "NESTABLE RIGID U-CRATES", the entire contents of which are incorporated by reference.

BACKGROUND

Packaging takes many forms. One widely popular construction includes a pair of laminated paperboard top and bottom U-shaped channels (U-shaped members or U-crates) configured for one to fit within the other. These packages have become a standard for objects that are linear and/or readily damaged. One well recognized and industry acclaimed package is the REDDI-CRATE® commercially available from ITW Reddi-Pac of Lake Zurich, Ill.

Although the U-shaped members themselves are extremely successful, one drawback is that the U-shaped members must be shipped and stored in their assembled form. As such, the shipping costs and storage costs (and space) can be quite substantial, in large measure because so much of the empty crate is air. This can be problematic as the U-shaped members become larger in sectional area and length.

Prior solutions involve embossing an area or making cuts through the entire U-shaped member in its base and subsequently taping the edges back together such that the U-shaped member can be opened and stacked for shipping. These solutions, however, do not necessarily provide the same strength and protection of the original, unembossed or uncut U-member. Embossing may cause slight gaps and inhibit folding of U-board to its original shape, while cutting straight through a wall and then taping may affect the structural integrity of the U-member.

Accordingly, there exists a need for U-shaped packages that are configured for more densely packing the containers for shipping and storage. More desirably, such a configuration has little to no adverse effect on the strength and integrity of the container as it is used for shipping goods.

BRIEF SUMMARY

A high density nesting packaging container has first and second preformed, rigid U-shaped members each having a U-shaped cross-section when configured for packaging use. The U-shaped members are configured to fit into one another to form a rectangular cross-section container. Each of the U-shaped members has a base wall and opposing side walls, the base and side walls and the intersection of the base and side walls being rigid. The base wall has a thickness through which one or more slits are formed.

In an embodiment, a narrow slit is formed in the base wall, extending longitudinally along the base wall and formed from an inner surface of the wall into the thickness of the base wall. The base wall is openable along the slit, dividing the base into two parts so as to form a generally W-configuration cross-section. The thus W-configured U-shaped members are nestable with each other. In an embodiment, a plurality of slits are formed, parallel to one another, dividing the base into more than two parts, and openable to form the generally W-shaped, or zigzagged, configuration.

When the base wall is closed to form the U-shaped member, the opposing surfaces formed by the slit(s) abut one another to maintain the U-shaped members in the U-shaped cross-section. The U-shaped members may have a coating, such as a liquid-resistant coating, on a surface thereof.

A single U-shaped member can also be used to protect, for example, the edge or face of an object, such as a window frame, door or the like. Such a member includes a preformed, rigid U-shaped member having a U-shaped cross-section defined by a base wall and opposing upstanding side walls. The base and side walls and the intersection of the base and side walls are rigid relative to one another such that the upstanding side walls are not foldable onto the base. The base wall has a thickness and a slit formed therein. The slit extends longitudinally along the base wall and is formed from an inner surface of the base wall into the thickness of the wall. The base wall is openable along the slit so as to form a generally W-shaped configuration cross-section such that others of the members, when so opened to form the W-shaped configuration are nestable with each other. When the base wall is closed to the U-shaped cross-section, the opposing surfaces formed by the slit abut one another to maintain the U-shaped member in the U-shaped cross-section.

These and other features and advantages of the present disclosure will be apparent from the following detailed description, in conjunction with the appended claims.

DETAILED DESCRIPTION

Figure 1:
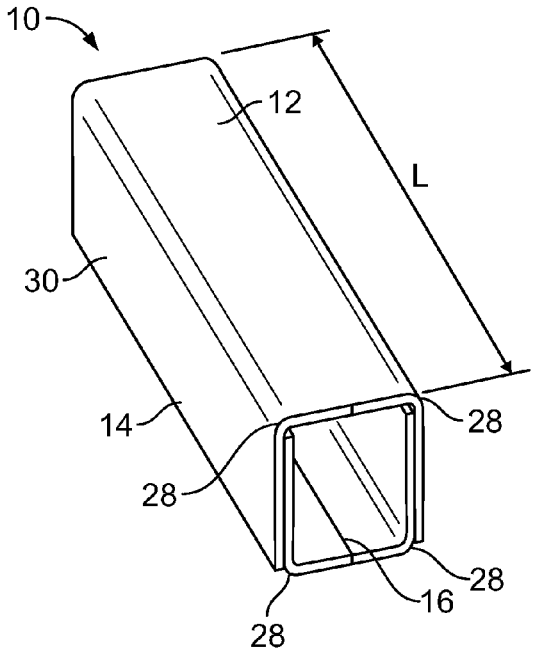
FIG. 1 is perspective view of a packaging container that is configured for nestable stacking and storing.
Figure 2:
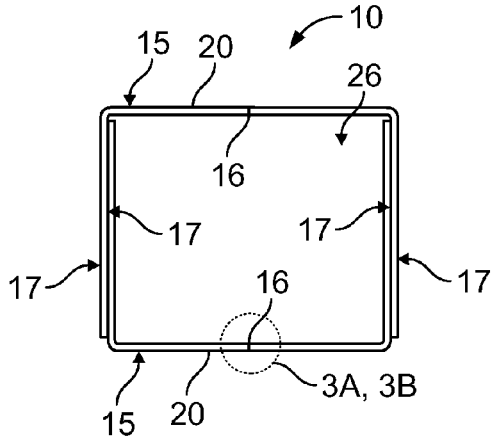
FIG. 2 is an end view of a packaging container in the in-use, U-shaped configuration.

While the present disclosure is susceptible of embodiment in various forms, there is shown in the drawings and will hereinafter be described presently preferred embodiments with the understanding that the present disclosure is to be considered exemplifications of the and is not intended to limit the disclosure to the specific embodiments illustrated.

Referring now to the figures and in particular to FIG. 1, there is shown an exemplary packaging container 10, configured to enclose an object. The container 10 is, for example, a REDDI-CRATE® commercially available from ITW Reddi-Pac of Lake Zurich, Ill.

In an embodiment, the container 10 is formed as a pair of U-shaped members 12, 14, having a U-shaped cross-section and that are formed from laminated paperboard. Other materials can, of course, be used. Each of the U-shaped members 12,14 includes a base wall 15, and side walls 17 generally perpendicular to the base wall 15. The U-shaped members 12, 14 have been shown to be extremely strong, having a high degree of structural integrity.

The U-shaped members 12,14 are each formed from a layered, or laminated, construction of paper and/or paper board that is subsequently formed into a U-shape (U-shaped cross-section). The U-shaped members 12,14 generally are rigid; that is, the walls are rigidly formed into the U-shape (transverse relative to the base) and are rigid longitudinally along the length of the channel. The walls do not fold down onto the base.

In another embodiment, a U-shaped member has a reinforced base and corners fashioned from alternating layers of paper and/or paper board material of varying widths or strips, and laminating the strips into a board. Narrow strips of material are disposed between wider strips of material such that the narrow strips of material serve as a reinforcing material. The narrow strips of reinforcing material may or may not be the same material as the wider strips of material. In another embodiment, the reinforcing material layer extends across the bottom wall and at least partially up the side walls of the U-board to cover fully the bottom wall of the internal channel as well as the radius of curvature of the corners of the internal channel.

Figure 3A:
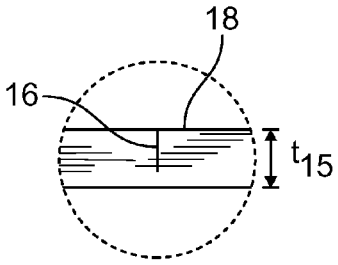
FIGS. 3A and 3B are enlarged views of the slit area of the container of FIG. 2 in use (FIG. 3A) and as the container is opened to the W-configuration cross-section (FIG. 3B)
Figure 3B:
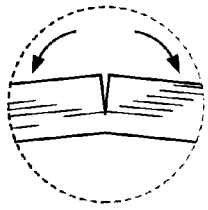

As seen in FIG. 3A, the members 12, 14 includes a slit 16 in the inner wall 18 of the respective member 12, 14 that extends longitudinally along the length L of the base wall 15. For purposes of this disclosure, the base wall 15 refers to the central portion 20 of the U in the member 12, 14 (in the container 10, the upper and lower or inner and outer) U-shaped members 12, 14. The slit 16 is a narrow cut, not a gouge or other substantial material-removing process. The slit 16 is formed through the base wall 15, from the inside, inner surface 26, through about 60 percent to about 70 percent of the wall thickness $t_{15}$.

In an embodiment, the slit is formed in the center of the base wall 15 of the U-shaped member 12, 14. In another embodiment, two slits are formed, dividing the base wall into thirds. In still another embodiment, more than two slits are formed parallel to one another and dividing the base wall into a plurality of portions. It is anticipated that still other embodiments may be formed with the slit through more than 70% of the wall thickness or less than 60% of the wall thickness, and such depth may depend on the number of slits formed in the base wall 15. It will be appreciated by those with skill in the art that the slit will also penetrate reinforcing material of the base wall that may be present in the 60-70% of the wall thickness.

The slit 16 can be made with a tool to form a slit 16 or separation of the material. Such a tool has a thickness of about $1/64^{th}$ inch, such that the width of the slit is $1/32^{nd}$ inch or less, and preferably about $1/64^{th}$ inch wide. One tool uses a non-serrated blade. It will, however, be appreciated that other cutting methods may be used such as laser cutting, or the like, including cutting methods not yet known.

Figure 4:
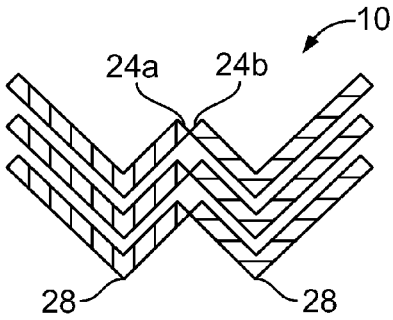
FIG. 4 is an end view of packaging containers that are nested with one another.

It will be appreciated from the figures that each of the U-shaped members 12, 14 of the present stackable slit-wall container 10, when opened, forms a W-configuration (indicated at 22) that allows the members 12, 14 of the container 10 to be stacked or nested as shown in FIG. 4. Stacking increases the density of the members 12, 14 for storage and shipping, thus providing an economical and effective arrangement for such container 10 members 12, 14.

Advantageously, the slit 16 does not substantially effect the structural integrity of the members 12, 14. First, because the slit 16 is narrow, the two opposing walls or surfaces 24*a,b* of the member 12, 14, when the member 12, 14 is or "closed" to form the U-shaped configuration, abut one another and minimize further inward folding. Thus, when the base wall 15 of the member 12, 14 is flattened (closed to the U-shaped configuration, as opposed to the shipping/storage open W-shaped configuration), the side walls 17 will be essentially parallel to one another and the member 12, 14 will not fold in on itself. When used to form a container (that is, with two members, for example, 12 and 14), once the upper and lower U-shaped members 12, 14 are fitted into one another to form the complete container 10, the members 12, 14 are typically strapped or taped to close the container 10. In this manner the side walls 17 of each member 12, 14 remain upright and are further supported to prevent the side walls 17 and the base wall(s) 15 from returning to the W-configuration 22.

It will be appreciated that the structural integrity of the members 12, 14 comes, in part, from the strength of the corners 28. It has been found that even though the base wall 15 is slit 16 through thickness $t_{15}$ up to about 60 percent to 70 percent of thickness $t_{15}$, the container 10 exhibits about 80 percent to 85 percent of the strength of a non-slit container.

In addition, the structural integrity of members 12, 14 can be bolstered by surface coating(s) 30. The U-shaped members 12, 14 can be manufactured having various surface coatings 30 that may include polymeric or other liquid-resistant coating so as to provide protection for the contents of the container 10 from water, and the like. As such, forming the slit 16 on the inside of the wall 15 eliminates creating any exposed regions on the outer surface of the members 12, 14 that could otherwise absorb or wick liquids which might compromise the integrity of the members 12, 14. Such coating may be on an outer surface, an inner surface, or both.

Figure 5A:
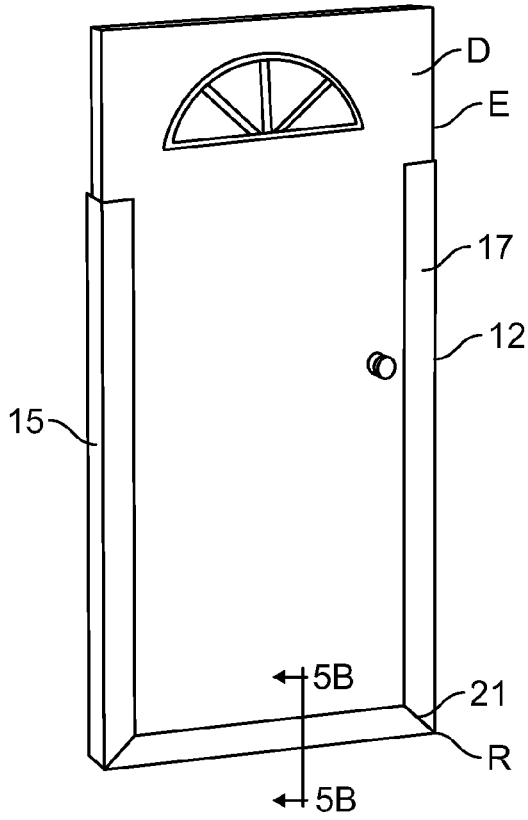
FIGS. 5A and 5B are a front and a partial sectional view of a single U-shaped member, where the illustrated single U-shaped member is used to provide edge protection for a door.
Figure 5B:
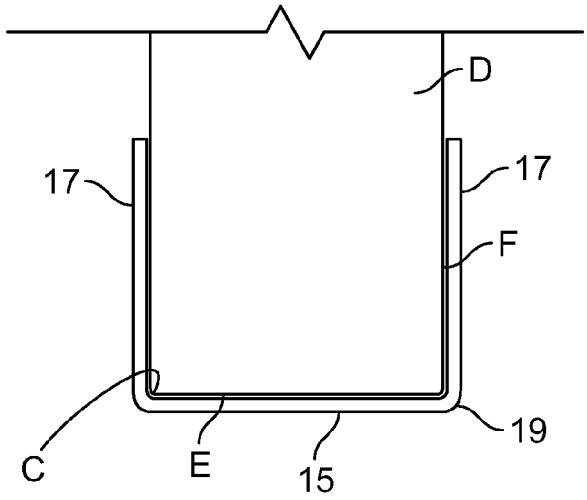

Referring now to FIGS. 5A and 5B, a single one of the nestable U-shaped members, for example, member 12, can be used to protect the edge E (side, bottom and/or top) of an object O, such as a window frame, door or the like. The illustrated member 12 has rigid side walls 17 (relative to the base 15), which protect the face F of the object O. In addition, due to the rigid side walls 17 and base 15, at the juncture thereof (indicated generally at 19), the corners C, as well as the edges E of the object O are protected. In addition, the cushioning effect of the multiple layers of material that form the member 12 prevents minor dents and scratches from occurring on the face F and edges E of the object O. Transverse cuts 21 can be formed in the side walls 17 to allow the member 12 to be bent along the base 15 to conform to the object O, for example, to extend around corners R of the object O.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing, it will be observed that numerous modifications and variations can be effected without departing from the true spirit and scope of the novel concepts of the present disclosure. It is to be understood that no limitation with respect to the specific embodiments illustrated is intended or should be inferred. The disclosure is intended to cover by the appended claims all such modifications as fall within the scope of the claims.

What is claimed is:

1. A high density nesting packaging element comprising:

a preformed, rigid U-shaped member having a U-shaped cross-section defined by a base wall and opposing upstanding side walls, the U-shaped member being formed from a laminated construction of paper board that is subsequently formed into the U-shape cross-section, the base and side walls and the intersection of the base and side walls being rigid relative to one another such that the upstanding side walls are not foldable onto the base, the base wall having a thickness and having at least one slit formed therein, the slit extending longitudinally along the base wall and formed from an inner surface thereof into the thickness of the base wall to define spaced apart opposing surfaces of the slit, the surfaces of the slit being parallel to one another, the slit having a width of less than about 1/32 inch between the surfaces of the slit and extending through about 60 percent to about 70 percent of the base wall thickness, the base wall being openable along the slit so as to form a generally W-shaped configuration cross-section such that others of the members, when so opened to form the W-shaped configuration are nestable with each other, and wherein when the base wall is closed to the U-shaped cross-section, the opposing surfaces formed by the slit abut one another to maintain the U-shaped member in the U-shaped cross-section.

2. The nesting packaging element of claim 1 wherein the width of the slit is about 1/64 inch.

3. The nesting packaging element of claim 1 wherein the U-shaped member has a liquid-resistant coating on a surface thereof.

4. The nesting packing element of claim 1 wherein the sidewalls are rigidly formed transverse relative to the base wall and are rigid longitudinally along the length of a channel, parallel to the length of the slits.

5. The nesting packing element of claim 1 wherein the U-shaped member has a reinforced base and corners fashioned from alternating layers of material of varying widths.

6. The nesting packing element of claim 5 wherein narrow strips of material are disposed between wider strips of material such that the narrow strips of material serve as a reinforcing material.

7. The nesting packing element of claim 6 wherein the narrow strips of reinforcing material is the same material as the wider strips of material.

8. The nesting packing element of claim 6 wherein the narrow strips of reinforcing material are formed from a different material than the wider strips of material.

9. A high density nesting packaging element comprising:

a preformed, rigid member having a base wall and opposing upstanding side walls, the base and side walls being rigid relative to one another, the U-shaped member being formed from a laminated construction of paper board that is subsequently formed into the U-shape cross-section, the base wall having a thickness and having at least one slit formed therein, the slit extending longitudinally along the base wall and formed from an inner surface thereof into the thickness of the base wall about 60 percent to about 70 percent of the base wall thickness, to define opposing spaced apart surfaces of the slit, the base wall being openable along the slit, such that: (i) when the base wall is in a closed position, the member has a U-shaped cross-section defined by the base wall and the side walls, and the opposing surfaces formed by the slit abut one another to maintain the member in the closed position; and (ii) when the base wall is in an opened position, the member has a generally W-shaped cross-section defined by the base wall and the side walls and the member is nestable with one or more other members.

10. The nesting packaging element of claim 9 wherein the width of the slit is less than about 1/32 inch.

11. The nesting packaging element of claim 9 wherein the U-shaped member has a liquid-resistant coating on a surface thereof.

12. The nesting packing element of claim 9 wherein narrow strips of material are disposed between wider strips of material such that the narrow strips of material serve as a reinforcing material.

13. The nesting package element of claim 9 including transverse cuts in the side walls for applying the element to an object.

* * * * *

UNITED STATES PATENT AND TRADEMARK OFFICE

CERTIFICATE OF CORRECTION

PATENT NO. : 8,474,687 B2
APPLICATION NO. : 13/021450
DATED : July 2, 2013
INVENTOR(S) : John A. Rometty et al.

It is certified that error appears in the above-identified patent and that said Letters Patent is hereby corrected as shown below:

In the Claims

Column 6,
Line 28, the phrase, "The nesting packing element" should read, "the nesting packaging element".
Line 32, the phrase, "The nesting package element" should read, "the nesting packaging element".

Signed and Sealed this
Twentieth Day of May, 2014

Michelle K. Lee

Michelle K. Lee
*Deputy Director of the United States Patent and Trademark Office*